US010989130B2

(12) United States Patent
Denk et al.

(10) Patent No.: US 10,989,130 B2
(45) Date of Patent: Apr. 27, 2021

(54) FUEL INJECTORS

(71) Applicant: Continental Automotive GmbH, Hannover (DE)

(72) Inventors: Frank Denk, Obertraubling (DE); Ulrich Wagner, Straubing (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 208 days.

(21) Appl. No.: 16/306,136

(22) PCT Filed: Jun. 1, 2017

(86) PCT No.: PCT/EP2017/063379

§ 371 (c)(1),
(2) Date: Nov. 30, 2018

(87) PCT Pub. No.: WO2017/207726

PCT Pub. Date: Dec. 7, 2017

(65) Prior Publication Data

US 2020/0340417 A1 Oct. 29, 2020

(30) Foreign Application Priority Data

Jun. 3, 2016 (DE) ..... 10 2016 209 770.9

(51) Int. Cl.
*F02M 51/00* (2006.01)
*F02D 41/20* (2006.01)
(Continued)

(52) U.S. Cl.
CPC ..... *F02D 41/20* (2013.01); *F02M 51/061* (2013.01); *F02M 61/161* (2013.01);
(Continued)

(58) Field of Classification Search
CPC ..... F02D 41/247; F02D 41/402; F02D 41/20; F02D 2041/2003; F02D 2041/2058;
(Continued)

(56) References Cited

U.S. PATENT DOCUMENTS 6,142,395 A 11/2000 Reiter et al. ..... 239/585.1
7,469,679 B2 12/2008 Puckett et al. ..... 123/446
(Continued)

FOREIGN PATENT DOCUMENTS

CN 102889146 A 1/2013 ..... F02D 41/22
DE 198 23 980 A1 12/1999 ..... B61C 9/50
(Continued)

OTHER PUBLICATIONS

German Office Action, Application No. 10 2016 209 770.9, 5 pages, dated Dec. 27, 2016.
(Continued)

*Primary Examiner* — John Kwon
(74) *Attorney, Agent, or Firm* — Slayden Grubert Beard PLLC

(57) ABSTRACT

Various embodiments may include a method for adapting the opening behavior of a fuel injector having a solenoid drive, the method comprising: applying a voltage pulse having a predetermined electrical voltage to the solenoid drive; acquiring a time profile of the strength of a current flowing through the solenoid drive; comparing the acquired time profile with a reference profile; and adjusting a value of a mechanical parameter of the fuel injector to reduce a deviation between the acquired time profile of the strength of the current and the reference profile.

8 Claims, 1 Drawing Sheet

(51) Int. Cl.
*F02M 51/06* (2006.01)
*F02M 61/16* (2006.01)

(52) U.S. Cl.
CPC ..... *F02D 2041/2051* (2013.01); *F02D 2041/2055* (2013.01); *F02M 2200/8092* (2013.01)

(58) Field of Classification Search
CPC .... F02D 2200/0618; F02D 2041/2055; F02M 51/0678; F02M 61/1833; F02M 51/0685; F02M 51/0671; F02M 61/1893; Y02T 10/44
See application file for complete search history.

(56) References Cited

U.S. PATENT DOCUMENTS

| | | | | |
|---|---|---|---|---|
| 8,813,723 | B2 | 8/2014 | Bagnasco et al. | 123/490 |
| 8,935,114 | B2 | 1/2015 | Beer et al. | 702/65 |
| 2006/0065870 | A1* | 3/2006 | Mori | F02M 63/0225 251/129.07 |
| 2013/0341421 | A1 | 12/2013 | Mueller et al. | 239/5 |
| 2014/0345571 | A1 | 11/2014 | Hauser et al. | 123/478 |
| 2016/0177855 | A1* | 6/2016 | Kusakabe | F02M 65/005 123/490 |
| 2016/0237937 | A1* | 8/2016 | Kusakabe | F02M 61/1833 |

FOREIGN PATENT DOCUMENTS

| | | | | |
|---|---|---|---|---|
| DE | 10 2008 002 487 | A1 | 12/2009 | B23K 26/00 |
| DE | 10 2011 087 418 | A1 | 6/2013 | F02D 41/20 |
| DE | 10 2012 210 134 | A1 | 12/2013 | F02D 41/38 |
| GB | 2497515 | A | 6/2013 | F02M 65/00 |
| JP | 1113581 | A | 1/1999 | F02M 51/06 |
| JP | 2000034965 | A | 2/2000 | F02M 51/06 |
| JP | 2008523307 | A | 7/2008 | F02M 47/00 |
| JP | 2010249069 | A | 11/2010 | F02D 41/20 |
| KR | 20120052978 | A | 5/2012 | F02D 41/20 |
| WO | 88/05131 | A1 | 7/1988 | F02D 77/08 |
| WO | 2017/207726 | | 12/2017 | F02D 41/20 |

OTHER PUBLICATIONS

International Search Report and Written Opinion, Application No. PCT/EP2017/063379, 19 pages, dated Sep. 7, 2017.
Korean Notice of Allowance, Application No. 2020008728249, 3 pages, dated Feb. 5, 2020.
Chinese Office Action, Application No. 201780034428.X, 19 pages, dated Nov. 18, 2020.

* cited by examiner

FUEL INJECTORS

CROSS-REFERENCE TO RELATED APPLICATIONS

This application is a U.S. National Stage Application of International Application No. PCT/EP2017/063379 filed Jun. 1, 2017, which designates the United States of America, and claims priority to DE Application No. 10 2016 209 770.9 filed Jun. 3, 2016, the contents of which are hereby incorporated by reference in their entirety.

TECHNICAL FIELD

The present disclosure relates to internal combustion engines. Various embodiments may include fuel injectors and/or a method for adapting the opening behavior of a fuel injector having a solenoid drive.

BACKGROUND

During the operation of directly operated coil injectors, in particular fuel injectors for motor vehicles having an internal combustion engine, with the same current and voltage values, electrical, magnetic and mechanical tolerances result in different temporal opening and closing behaviors of the injectors and therefore in variations in the injection quantity. The relative differences in injection quantity from one injector to another become larger as the injection times become shorter. Until now, these relative differences in quantity have been small. The need for smaller injection quantities and injection times now means that the influence in terms of the difference in quantity has to be taken into account. Influences such as variations in the injector opening time (OPP 1) have to be taken into account to a greater extent. Until now, it has been possible to solve this problem merely with relatively small component tolerances, which entails considerable expenditure and corresponding costs.

SUMMARY

The teachings of the present disclosure may be embodied in a simple and cost-effective solution. For example, some embodiments include a method for adapting the opening behavior of a fuel injector having a solenoid drive, the method comprising: applying a voltage pulse having a predetermined electrical voltage to the solenoid drive, acquiring a time profile of the strength of the current flowing through the solenoid drive, comparing the acquired time profile with a reference profile, and adjusting a mechanical parameter value of the fuel injector in order to reduce a deviation between the acquired time profile of the strength of the current and the reference profile.

In some embodiments, the mechanical parameter value has a parameter value from the group which contains an idle stroke value, a needle stroke value and a working stroke value.

In some embodiments, the comparison of the acquired time profile with the reference profile comprises determining a difference between a first time at which a predetermined event occurs in the acquired time profile of the strength of the current, and a second time at which the predetermined event occurs in the reference profile.

In some embodiments, the adjustment of the mechanical parameter value is carried out as a function of the determined difference.

In some embodiments, the predetermined event comprises an event from the group which contains impacting of a movable armature onto a nozzle needle and impacting of the nozzle needle onto a pole piece.

In some embodiments, the predetermined electrical voltage is selected in such a way that a quasi-static input of magnetic field energy takes place.

In some embodiments, the predetermined electrical voltage is between 2 V and 16 V.

In some embodiments, the method also comprises: applying again a voltage pulse having the predetermined electrical voltage to the solenoid drive, acquiring a further time profile of the strength of the current flowing through the solenoid drive, comparing the acquired further time profile with the reference profile, and adjusting again the mechanical parameter value of the fuel injector in order to reduce a deviation between the acquired further time profile of the strength of the current and the reference profile.

As another example, some embodiments include a device for adapting the opening behavior of a fuel injector having a solenoid drive, the device comprising: an application unit for applying a voltage pulse having a predetermined electrical voltage to the solenoid drive, an acquisition unit for acquiring a time profile of the strength of the current flowing through the solenoid drive, a comparator unit for comparing the acquired time profile with a reference profile, and an adjustment unit for adjusting a mechanical parameter value of the fuel injector in order to reduce a deviation between the acquired time profile of the strength of the current and the reference profile.

As another example, some embodiments include a computer program which, when it is executed by a processor, is designed to carry out the method as described above.

BRIEF DESCRIPTION OF THE DRAWINGS

Further teachings of the present disclosure may be understood in light of the description of an exemplary embodiment which follows.

DETAILED DESCRIPTION

Figure 1:
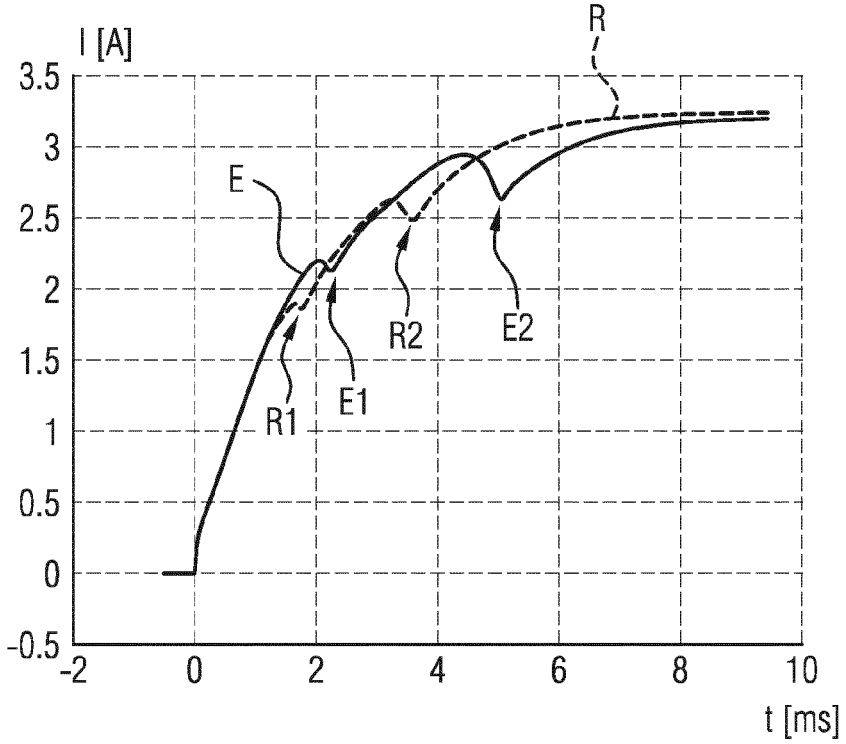
FIG. 1 shows a diagram of an acquired current profile and a reference profile according to the teachings herein.

In some embodiments, a method for adapting the opening behavior of a fuel injector having a solenoid drive comprises the following: (a) applying a voltage pulse having a predetermined electrical voltage to the solenoid drive, (b) acquiring a time profile of the strength of the current flowing through the solenoid drive, (c) comparing the acquired time profile with a reference profile, and (d) adjusting a mechanical parameter value of the fuel injector in order to reduce a deviation between the acquired time profile of the strength of the current and the reference profile. In some embodiments, adjusting one (or more) mechanical parameter values of the fuel injector on the basis of a comparison of the time current profile with a reference profile (reference current profile) easily permits the opening behavior of the fuel injector to be adjusted so as to be closer to the opening behavior corresponding to the reference profile.

In some embodiments, a voltage pulse is applied to the fuel injector whose opening behavior is to be adapted, and the time profile of the strength of the current flowing through the solenoid of the solenoid drive during the application of the voltage pulse is acquired. In other words, a predetermined (constant) electrical voltage is connected via the solenoid drive, and the resulting coil current is measured (in particular sampled at regular time intervals) and stored as a function of the time. The acquired profile of the strength of the current is then compared with a reference profile, wherein the reference profile represents the desired time profile of the strength of the current (and therefore the desired opening behavior). In the event of a deviation between the acquired (actual) current profile and the (desired) reference profile, at least one mechanical parameter value is now adjusted in order to reduce or compensate this deviation. In other words, the adjustment is carried out in such a way that when the voltage pulse is applied again and the current is acquired after the adjustment a current profile is expected which is closer to or equal to the reference profile.

In some embodiments, the mechanical parameter value has a parameter value from the group which contains an idle stroke value, a needle stroke value and a working stroke value. In this document, "idle stroke value" denotes, in particular, the distance between the position of rest of the movable armature of the solenoid drive and the position in which the armature impacts against the nozzle needle (or a driver coupled to the nozzle needle). In other words, "idle stroke value" denotes the distance the armature moves until it abuts against the nozzle needle. The time at which the armature impacts against the nozzle needle during actuation of the fuel injector, and therefore initiates the actual opening of the fuel injector, is also referred to as OPP1.

In this document, "needle stroke value" denotes, in particular, the distance between the position of rest of the nozzle needle and the position in which the nozzle needle which is entrained by the armature is braked by impacting against a pole piece. In other words, "needle stroke value" denotes the maximum distance the nozzle needle moves. The time at which the nozzle needle impacts against the pole piece during actuation of the fuel injector, and therefore completes the opening of the fuel injector, is also referred to as OPP2.

In this document, "working stroke value" denotes, in particular, the distance between the position of rest of the movable armature of the solenoid drive and the position in which the armature and the nozzle needle which is entrained by the armature are braked by impacting against a pole piece. In other words, "working stroke value" denotes the sum of the "idle stroke value" and of the "needle stroke value".

The mechanical parameter values just mentioned can be formed, in particular, by axially shifting one or more stop pieces. This shifting can be carried out, in particular, by a technician, that is to say manually, or alternatively by a robot, that is to say automatically.

In some embodiments, the comparison of the acquired time profile with the reference profile comprises determining a difference between a first time at which a predetermined event occurs in the acquired time profile of the strength of the current, and a second time at which the predetermined event occurs in the reference profile. In other words, a time difference between the respective occurrence of an event which can be detected in the acquired time profile and in the reference profile (for example as an extreme) is determined. This difference is then a measure for to what extent the event occurs too early or too late at the examined fuel injector.

In some embodiments, the adjustment of the mechanical parameter value is carried out as a function of the determined difference. In other words, the adjustment takes place in such a way that the determined difference is smaller or is eliminated when the voltage pulse is applied again to the fuel injector. The amount by which the mechanical parameter value is adjusted is therefore selected in such a way that the determined difference is reduced or eliminated as expected.

In some embodiments, the predetermined event comprises an event from the group which contains impacting of a movable armature onto a nozzle needle and impacting of the nozzle needle onto a pole piece. The impacting of the movable armature against the nozzle needle takes place as mentioned above at the time OPP1, and the impacting of the nozzle needle against the pole piece takes place at the time OPP2. These times can be determined in a manner known per se by analyzing the acquired time profile of the coil current and of the reference profile.

If it is detected by the comparison that the time OPP1 in the acquired current profile occurs later than in the reference profile, this lateness can be corrected by reducing the idle stroke. If the time OPP1 occurs too early, the idle stroke is correspondingly increased. If it is detected by the comparison that the time OPP2 in the acquired current profile occurs later than in the reference profile, this lateness can be corrected by reducing the needle stroke. If the time OPP2 occurs too early, the needle stroke is correspondingly increased.

In some embodiments, the predetermined electrical voltage is selected in such a way that a quasi-static input of magnetic field energy takes place. In other words, the predetermined electrical voltage is selected in such a way that few or no eddy currents occur. This facilitates the detection of the predetermined events in the current profile and reference profile as well as the detection of the corresponding times.

In some embodiments, the predetermined electrical voltage is between 2 V and 16 V, in particular between 4 V and 12 V, in particular between 6 V and 9 V, and is in particular about 7.5 V. In other words, a voltage is applied to the fuel injector which is lower than or at maximum equal to the battery voltage in a typical motor vehicle. The voltage used is therefore significantly lower than the increased boost voltage of approximately 65 V which is usually employed to open the fuel injector.

In some embodiments, the method also comprises the following: (a) applying again a voltage pulse having the predetermined electrical voltage to the solenoid drive, (b) acquiring a further time profile of the strength of the current flowing through the solenoid drive, (c) comparing the acquired further time profile with the reference profile, and (d) adjusting again the mechanical parameter value of the fuel injector in order to reduce a deviation between the acquired further time profile of the strength of the current and the reference profile. In some embodiments, the voltage pulse is applied to the fuel injector again after the adjustment of the mechanical parameter value. If there is still a deviation (possibly beyond a threshold value) between the acquired current profile and the reference profile, renewed or further adjustment of the mechanical parameter value is then carried out. The renewed application of the voltage pulse, acquisition of the current profile, comparison and adjustment can be repeated as often as desired in order to adapt the opening behavior iteratively.

In some embodiments, a device for adapting the opening behavior of a fuel injector having a solenoid drive comprises the following: (a) an application unit for applying a voltage pulse having a predetermined electrical voltage to the solenoid drive, (b) an acquisition unit for acquiring a time profile of the strength of the current flowing through the solenoid drive, (c) a comparator unit for comparing the acquired time profile with a reference profile, and (d) an adjustment unit for adjusting a mechanical parameter value of the fuel injector in order to reduce a deviation between the acquired time profile of the strength of the current and the reference profile.

The device described is configured, in particular, for using the method described above. The application unit is configured to prepare the voltage pulse, and the acquisition unit is configured to acquire the strength of the coil current. The comparator unit is configured to compare the acquired current profile with the reference profile. The comparison can be carried out in a more or less automated fashion here. In particular, the comparator unit may have a screen for displaying the acquired time current profile and the reference profile, so that under certain circumstances a technician can detect a deviation visually. In this context, the comparator unit may also mark or highlight deviations in an automated fashion, in order to assist and facilitate the manual comparison by the technician. Alternatively, the comparator unit may carry out the comparison fully automatically, for example by determining the times OPP1 and/or OPP2 in the acquired current profile and in the reference profile. The adjustment unit may be a tool with which a technician can adjust the mechanical parameter value. However, the adjustment unit may also be a robot which carries out the adjustment fully automatically.

In some embodiments, a computer program which, when it is executed by a processor, is designed to carry out the method described above. Within the meaning of this document, the designation of a computer program of this kind is equivalent to the concept of a program element, a computer program product and/or a computer-readable medium which contains instructions for controlling a computer system, in order to coordinate the manner of operation of a system or of a method in a suitable manner, in order to achieve the effects associated with the method according to the invention.

The computer program can be implemented as a computer-readable instruction code in any suitable programming language, such as in JAVA, C++ etc. for example. The computer program can be stored on a computer-readable storage medium (CD-ROM, DVD, Blu-ray disk, removable drive, volatile or non-volatile memory, integral memory/processor etc.). The instruction code can program a computer or other programmable devices, such as in particular a control unit for an engine of a motor vehicle, in such a way that the desired functions are executed. Furthermore, the computer program can be provided in a network such as, for example, the Internet, from which a user can download it as required.

In some embodiments, a computer program may include software. In some embodiments, the methods described may be implemented by means of one or more specific electrical circuits, e.g. as hardware or in any desired hybrid form, e.g. by means of software components and hardware components.

In particular, some embodiments of the teachings herein are described by way of method claims and other embodiments are described by way of device claims. However, it will become immediately clear to a person skilled in the art on reading this application that, unless explicitly stated otherwise, in addition to a combination of features which are associated with one type of subject matter of the invention, any combination of features which are associated with different types of subjects of the invention is also possible. It should be noted that the embodiments described below are merely a limited selection of possible variant embodiments.

In some embodiments, in the course of, or towards the end of, the manufacture of fuel injectors with a solenoid drive the steps described below for adapting the opening behavior of each fuel injector are carried out, in order to provide fuel injectors with an at least approximately identical opening behavior. More specifically, a voltage pulse having a predetermined electrical voltage is applied to each fuel injector. In this context, the predetermined voltage is preferably selected to be so low (between 5 and 12 V) that only few or no eddy currents occur. The voltage pulse lasts at least so long that the fuel injector is opened completely. At the same time, the time profile of the strength of the current flowing through the solenoid drive is acquired. In this context, the strength of the current is sampled, for example, with a predetermined frequency, and stored. Such a time current profile E is shown in FIG. 1.

The acquired time current profile E is then compared with a reference profile. Such a reference profile R is also shown in FIG. 1. The value of a mechanical parameter of the fuel injector is then adjusted on the basis of this comparison, in order to reduce or compensate a deviation between the acquired time profile of the strength of the current and the reference profile. Both the comparison of the profiles E and R of the current and the subsequent adjustment of the mechanical parameter value can be carried out manually (by a technician), automatically (by a computer and a robot) or semi-automatically (by a technician and a computer).

The comparison of the acquired current profile E with the reference profile R and the subsequent adjustment of the mechanical parameter value serves in principle to adjust the fuel injector in such a way that the acquired current profile (when the voltage pulse is applied again to the solenoid drive) is as close as possible to the reference current profile.

More specifically, during the comparison, in particular the times OPP1 (armature has overcome the idle stroke and reaches the nozzle needle) and OPP2 (nozzle needle reaches upper stop so that the injector is completely open) are considered both in the acquired current profile and in the reference profile. Owing to the low voltage, these times are relatively easy to see in the curve profile and/or to determine computationally. In FIG. 1 the events OPP1 and OPP2 in the reference profile R are respectively characterized by R1 (after approximately 1.5 ms) and by R2 (after approximately 3.5 ms) and in the acquired current profile E respectively by E1 (after approximately 2.25 ms) and by E2 (after approximately 5 ms). Compared to the reference profile R, in the acquired current profile E both OPP1 and OPP2 therefore occur too late. This lateness is to be corrected only by adjustment. This can advantageously be carried out iteratively. For example, the idle stroke of the fuel injector can be adjusted first. If (after renewed application of the voltage pulse and acquisition of the strength of the current) it is detected that the times for OPP1 are the same (to a sufficient extent), if appropriate the needle stroke can also be adjusted in order to equalize the times for OPP2.

Figure 2:
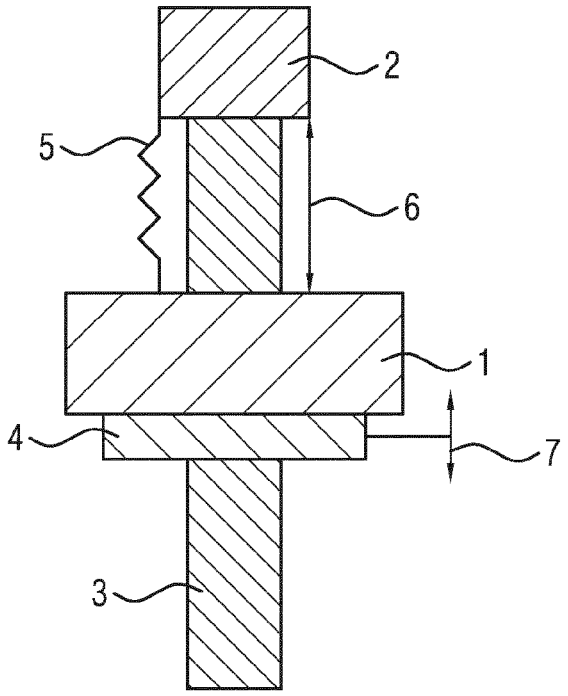
FIG. 2 shows a fuel injector with an adjustable idle stroke incorporating teachings of the present disclosure.

FIG. 2 shows a fuel injector with an adjustable idle stroke. More specifically, FIG. 2 shows a fuel injector with a movable armature 1 and a driver 2 which is attached to the nozzle needle 3. The armature 1 is shown in its initial position, where it rests on a shiftable stop 4. A spring 5 is attached between the armature 1 and the driver 2. The idle stroke, that is to say the distance traveled by the armature until it abuts against the driver 2 is characterized by the arrow 6. The idle stroke 6 can then be adjusted by axially shifting the stop 4, that is to say in the direction of the arrow 7. In order to reduce the above-mentioned lateness when the state OPP1 is reached, the technician or robot will shift the stop 4 slightly upward, so that the idle stroke 6 (and therefore the time required to reach the state OPP1) is correspondingly reduced.

LIST OF REFERENCE SIGNS

R Reference profile
R1 OPP1 in the reference profile
R2 OPP2 in the reference profile
E Acquired current profile
E1 OPP1 in the acquired current profile
E2 OPP2 in the acquired current profile
t Time
I Strength of the current
1 Armature
2 Driver
3 Nozzle needle
4 Stop
5 Spring
6 Idle stroke
7 Arrow

What is claimed is:

1. A method for adapting the opening behavior of a fuel injector having a solenoid drive, the method comprising:

applying a voltage pulse having a predetermined electrical voltage to the solenoid drive;

acquiring a time profile of the strength of a current flowing through the solenoid drive;

comparing the acquired time profile with a reference profile; and adjusting a value of a mechanical parameter of the fuel injector to reduce a deviation between the acquired time profile of the strength of the current and the reference profile;

wherein comparing the acquired time profile with the reference profile comprises determining a difference between a first time at which a predetermined event occurs in the acquired time profile of the strength of the current, and a second time at which the predetermined event occurs in the reference profile.

2. The method as claimed in claim 1, wherein the mechanical parameter is selected from the group consisting of: an idle stroke, a needle stroke, and a working stroke.

3. The method as claimed in claim 1, wherein adjusting the value of the mechanical parameter value depends on the determined difference.

4. The method as claimed in claim 1, wherein the predetermined event comprises an event selected from the group consisting of: impact of a movable armature onto a nozzle needle and impact of the nozzle needle onto a pole piece.

5. The method as claimed in claim 1, wherein the predetermined electrical voltage provides a quasi-static input of magnetic field energy.

6. The method as claimed in claim 1, wherein the predetermined electrical voltage is between 2 V and 16 V.

7. The method as claimed in claim 1, further comprising:

applying a second voltage pulse having the predetermined electrical voltage to the solenoid drive;

acquiring a second time profile of the strength of the current flowing through the solenoid drive;

comparing the acquired second time profile with the reference profile; and adjusting the value of the mechanical parameter to reduce a deviation between the acquired second time profile of the strength of the current and the reference profile.

8. A device for adapting the opening behavior of a fuel injector having a solenoid drive, the device comprising:

an application unit for applying a voltage pulse having a predetermined electrical voltage to the solenoid drive;

an acquisition unit for acquiring a time profile of the strength of the current flowing through the solenoid drive;

a comparator unit for comparing the acquired time profile with a reference profile; and an adjustment unit for adjusting a value of a mechanical parameter of the fuel injector to reduce a deviation between the acquired time profile of the strength of the current and the reference profile;

wherein comparing the acquired time profile with the reference profile comprises determining a difference between a first time at which a predetermined event occurs in the acquired time profile of the strength of the current, and a second time at which the predetermined event occurs in the reference profile.

* * * * *